US012781530B2

(12) United States Patent
Nansteel

(10) Patent No.: US 12,781,530 B2
(45) Date of Patent: Nov. 3, 2026

(54) SUPPORT STRUCTURE AND METHOD FOR MANUFACTURING THEREOF

(71) Applicant: Maria Nansteel, Spring City, PA (US)

(72) Inventor: Maria Nansteel, Spring City, PA (US)

( * ) Notice: Subject to any disclaimer, the term of this patent is extended or adjusted under 35 U.S.C. 154(b) by 149 days.

(21) Appl. No.: 18/944,207

(22) Filed: Nov. 12, 2024

(65) Prior Publication Data

US 2025/0369249 A1 Dec. 4, 2025

Related U.S. Application Data

(63) Continuation-in-part of application No. 18/677,847, filed on May 29, 2024.

(51) Int. Cl.
*E04H 12/22* (2006.01)
*E04F 11/18* (2006.01)

(52) U.S. Cl.
CPC ..... *E04H 12/2292* (2013.01); *E04F 11/1846* (2013.01); *E04F 2011/1889* (2013.01)

(58) Field of Classification Search
CPC ..... E04F 11/1817; E04F 2011/1821; E04F 11/18; E04F 11/1812; E04H 12/2269; E04H 12/2253; E04H 12/2292
See application file for complete search history.

(56) References Cited

U.S. PATENT DOCUMENTS

| | | | | |
|---|---|---|---|---|
| 3,788,608 | A | 1/1974 | Raymond | |
| 4,015,827 | A | 4/1977 | Brand | |
| 5,551,194 | A * | 9/1996 | Toomey | E04F 11/1863 256/65.16 |
| 5,568,909 | A | 10/1996 | Timko | |
| 5,636,482 | A | 6/1997 | Klager | |
| 5,842,685 | A | 12/1998 | Purvis | |
| 5,957,146 | A * | 9/1999 | Corey | A61H 3/00 52/645 |
| 6,015,139 | A | 1/2000 | Weber | |
| 6,279,880 | B1 | 8/2001 | Hawks, Jr. | |
| 6,336,620 | B1 | 1/2002 | Belli | |
| 7,377,491 | B2 | 5/2008 | Fuoco | |
| 7,438,273 | B2 | 10/2008 | Tota | |
| 7,677,000 | B2 | 3/2010 | Walker | |
| 9,554,649 | B2 * | 1/2017 | Saich | H01Q 1/12 |
| 10,081,963 | B2 | 9/2018 | Neighbor | |
| 10,253,519 | B2 | 4/2019 | Magargee | |
| 10,407,916 | B1 | 9/2019 | Samad | |
| 11,555,325 | B1 | 1/2023 | Fox | |
| 11,840,843 | B2 * | 12/2023 | Fortin | E04F 11/1817 |
| 11,891,827 | B1 | 2/2024 | Oliphant | |
| 2008/0149791 | A1 * | 6/2008 | Bradley | E04H 17/20 248/220.21 |

(Continued)

FOREIGN PATENT DOCUMENTS

| | | | |
|---|---|---|---|
| JP | 2003213635 | | 7/2003 |
| JP | 3185591 U | * | 8/2013 |

*Primary Examiner* — Omar F Hijaz
(74) *Attorney, Agent, or Firm* — IP Works Law PLLC

(57) ABSTRACT

A support structure for handrail post repair, the support structure comprising a support frame having a flange base for stabilizing the support structure and a tube comprising a rail end and a ground end such that the tube is connected to the flange base at the ground end, a support rod attached to the tube for securing a handrail post and at least one locking element extending through the tube.

11 Claims, 13 Drawing Sheets

(56) References Cited

U.S. PATENT DOCUMENTS

| | | | | |
|---|---|---|---|---|
| 2009/0134289 | A1* | 5/2009 | Godwin | E04C 3/32 248/218.4 |
| 2009/0266026 | A1 | 10/2009 | Hannay et al. | |
| 2012/0255259 | A1 | 10/2012 | Shute | |
| 2013/0105753 | A1* | 5/2013 | Cavanagh | E04H 17/009 256/19 |
| 2013/0175422 | A1* | 7/2013 | Clarke | E04H 12/2269 248/523 |
| 2015/0082735 | A1 | 3/2015 | Truckner | |
| 2016/0060889 | A1 | 3/2016 | Tedesco | |
| 2021/0262247 | A1* | 8/2021 | Kightlinger | E04H 12/2261 |

* cited by examiner

SUPPORT STRUCTURE AND METHOD FOR MANUFACTURING THEREOF

CROSS-REFERENCE TO RELATED APPLICATIONS

This is application is a continuation in part of U.S. application Ser. No. 18/677,847 filed May 29, 2024 which is fully incorporated herein by reference.

TECHNICAL FIELD

The present disclosure generally relates to handrail support structures. More particularly, the present disclosure relates to a handrail support structure and method for manufacturing thereof. The support structure disclosed aids in preventing metal handrail posts from rotting below the surface when imbedded in concrete. Posts can be repaired by using the support structure to slip inside an existing hollow handrail post or sliding over an existing handrail post, hereinafter referred to as a "post," that is either a solid handrail post or a hollow handrail post. Disclosed support structure acts as a casing for metal posts to anchor on top of cement thus eliminating contact with concrete and avoiding further decay and rot. The disclosed support structure increases the lifespan of not only the post but the longevity of the entire handrail as well.

BACKGROUND

Replacing a handrail can be a costly endeavor, often requiring significant investment due to the specialized nature of the work and the dwindling number of craftsmen skilled in this area. Metal handrail posts imbedded in concrete have been rotting out for decades. Although handrails imbedded into concrete may vary in their size or design, their bases eventually succumb to the corrosive nature of the concrete. This leads to rusted out, crumbling handrail posts that are not only off-putting but pose a safety hazard to users of the handrail. In some jurisdictions and homeowner insurance policies, safe and structurally sound handrails are required and repairs necessary within a short deadline. As such, finding affordable, easy, and quick solutions for necessary repairs is increasingly important. Handrail posts have a repeating pattern of rotting from the decay the cement causes while the remainder of the rail is structurally safe. When a handrail is initially installed, a hole is drilled to support the handrail posts. Concrete is poured into this hole and levels itself in the hole once the handrail post is put into this hole. The concrete then settles down inside the hole, leaving a pocket, and allows rain to puddle, further decaying the posts as concrete eats metal. It is very common to see handrails rusted at the bottom. The introduction of repair feet offers a cost-effective alternative, allowing for the maintenance and repair of handrails without the need for complete replacements. This eliminates the need to core drill a railing back into the concrete avoiding any further damage caused by concrete-induced corrosion. There is also no need for welding to repair the handrails once the adhesive is added into the feet of the support structures as they become waterproof as well.

These repair feet are designed to address specific issues associated with metal handrail posts, particularly those embedded in concrete, and they prevent further damage caused by concrete-induced corrosion. There are no other alternatives for these repair feet to have them match up correctly to an existing handrail post.

Existing prior art, such as US20090266026A1, presents a two-piece sleeve for repairing wood rotting in utility poles. These poles, typically a minimum of seven inches in diameter, are concreted into the ground, making this method unsuitable for smaller handrail posts. Similarly, patents like U.S. Pat. No. 1,189,182A, which pertains to voltage regulators, and U.S. Pat. No. 1,155,325B1, an anchoring device for wooden posts, do not provide solutions applicable to the unique requirements of metal handrails. The former has no relevance, while the latter's design is too large and complex for use on a one-inch square handrail post.

Other patents, such as U.S. Pat. No. 10,081,963B2 and U.S. Pat. No. 10,253,519B2, also focus on utility pole repairs, featuring designs with open tops and bottoms, and multiple interconnecting plates. This is also a sleeve piece that will cap over the existing base plate and existing threaded bolt pattern already in the concrete. This allows the pole to not be removed. Existing base plates on utility poles are minimum 7" square by ¾ to 1" thickness. This is a load bearing plate for utility poles set at no less than 35' in height. Handrail requires a height between 36-38". These methods are tailored for larger poles and lack the solid base required to support metal handrail posts. In contrast, the repair feet discussed here are designed with a solid base plate, hereinafter referred to as "flange" or "flange base," open only at the top, which allows for filling with strong adhesives such as epoxy JB weld, 3M Epoxy adhesive, Loctite, E6000, Heavy Duty Gorilla glue, weld bond polyvinyl all of which are designed for metal-on-metal bonding so there is no need for welding. This also makes the repair feet waterproof. This design not only secures the handrail post but also eliminates the need to re-embed it in concrete, thus preventing and eliminating further decay.

Furthermore, patents like JP2003213635A, US20120255259A1, and U.S. Pat. No. 5,636,482 address various forms of wood post repairs or utility pole reinforcement but fail to offer viable solutions for metal handrails. They are either too large, involve unnecessary complexity, or require additional holes that could further damage the handrail. The repair feet, however, are tailored specifically for the dimensions and needs of metal handrails, ensuring a robust and durable fix without exacerbating existing issues. This focused approach makes them a superior option for maintaining the integrity and safety of metal handrail installations.

Previous repair methods for metal handrail posts have relied on flimsy 16-gauge tin strut channels, typically used for wood beam mounting, or on brittle cast iron feet that often cracked during installation. Recognizing over the past 20 years the persistent issue of concrete rotting metal handrail posts, I developed these repair feet. About 89% of homes have metal handrails and existing repair options are inadequate.

The above-mentioned limitations of the conventional handrails and supporting elements and techniques of repairing thereof would restrict the commercial/industrial deployment of the handrails. In an attempt to scale up the use of handrails, there remains a need for an efficient support structure and repairing and assembling method thereof that is capable of solving the aforementioned problems of the conventional handrails and supporting elements. Being specially designed to prevent rot in these upwardly extending repair supports.

SUMMARY OF THE INVENTION

In view of the foregoing, several support structures are disclosed. The support structure, as viewed in FIG. 1, includes a support frame and a support rod. The support frame includes a flange, a tube, and a support rod. The tube includes a first end such that the support rod is welded to the first end. The flange is welded to the same end to the tube and support rod. The support rod is all the way through the tube, protruding 5 inches. The support rod is configured to accept a pop rivet through the existing handrail post to secure the repair foot once adhesive is added into the existing handrail post.

In some embodiments of the present disclosure such as FIG. 3 support structure has a lock element. In the unlocked position, the lock element facilitates to adjust the at least one height of the existing handrail post within the tube.

In some embodiments of the present disclosure, the flange includes a plurality of apertures. The plurality of apertures facilitates to couple the support frame with a ground. The support frame is coupled to the ground upon insertion of a fastener in a corresponding aperture of the plurality of apertures. Preventing further contacts of post into concrete.

In some embodiments of the present disclosure, the lock element, in the locked position, engages with the existing handrail post to facilitate the need for one height.

In some embodiments of the present disclosure such as FIG. 3, the lock element, in the unlocked position, disengages from the existing handrail post to facilitate adjustment of the at least one height from the range of heights.

In some embodiments of the present disclosure, the first end is coupled with a flange. The hole is disposed at the second end. The hole facilitates to slidingly receive the existing handrail post.

In some embodiments of the present disclosure, the tube has a length of 8 inches.

In some embodiments of the present disclosure, the tube has a length of 6 inches.

In some embodiments of the present disclosure, the tube has a length of 4 inches.

In some embodiments of the present disclosure, the tube has a length of 3.75 inches.

In some embodiments of the present disclosure, the support rod has a length of 5 inches past any of the tubes.

In some aspects of the present disclosure, a method for assembling a support structure is disclosed. The method includes a step of cutting a tube such that the tube exhibits a first predefined length. The method further includes a step of grinding edges of first and second ends of the tube. The method further includes coupling a support rod to the first end of the tube. The method further includes welding tube and support rod to the flange on the same end making FIG. 1 support rod exhibits a second predefined length of 5" sticking out of any tube. The method further includes a step of inserting the support rod within the existing handrail post such that the support rod is secured by a pop rivet through existing post into support rod inside post.

In some embodiments of the present disclosure, the method as seen in FIG. 3, further includes a step of locking, by way of a lock element, the existing post that facilitates to exhibit at least one height for the existing handrail post. This application of the support structure is viable on either on a solid handrail post or hollow handrail post, hereinafter referred to as a "hollow tube handrail post" or "hollow handrail post."

In some embodiments of the present disclosure, the method FIG. 3, further includes a step of unlocking the lock element that facilitates to adjust the at least one height of the existing post within the tube.

In some embodiments of the present disclosure, the lock element exhibits a locked position such that the lock element engages with the handrail post that facilitates the handrail post to exhibit the at least one height from a range of heights to level handrail parallel to ground.

In some embodiments of the present disclosure, a tube is welded with a flange and matched up to existing handrail leg. This will be welded on for the more experienced professionals when preferred. This application of the support structure is viable on either on a hollow handrail post or solid handrail post.

Various objects, features, aspects and advantages of the present disclosure will become more apparent from the following detailed description of the embodiments of the invention, along with the accompanying drawings in which like numerals represent like components.

BRIEF DESCRIPTION OF THE DRAWINGS

Figure 1:
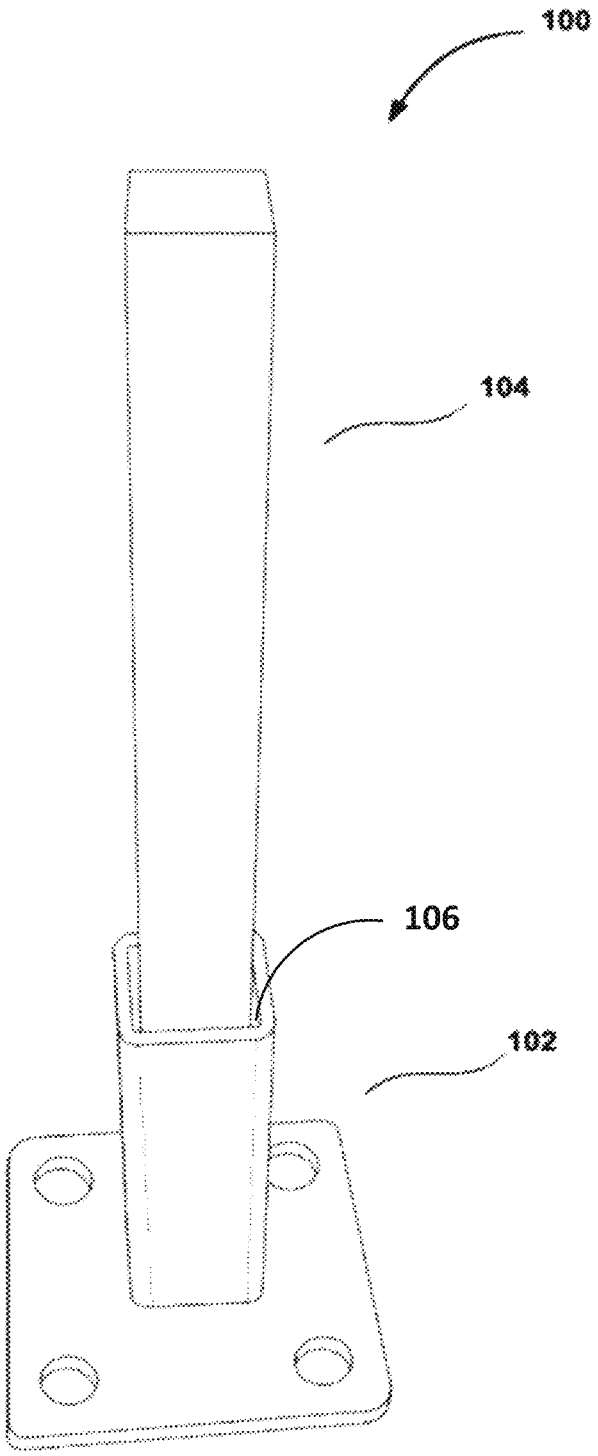
Figure 2:
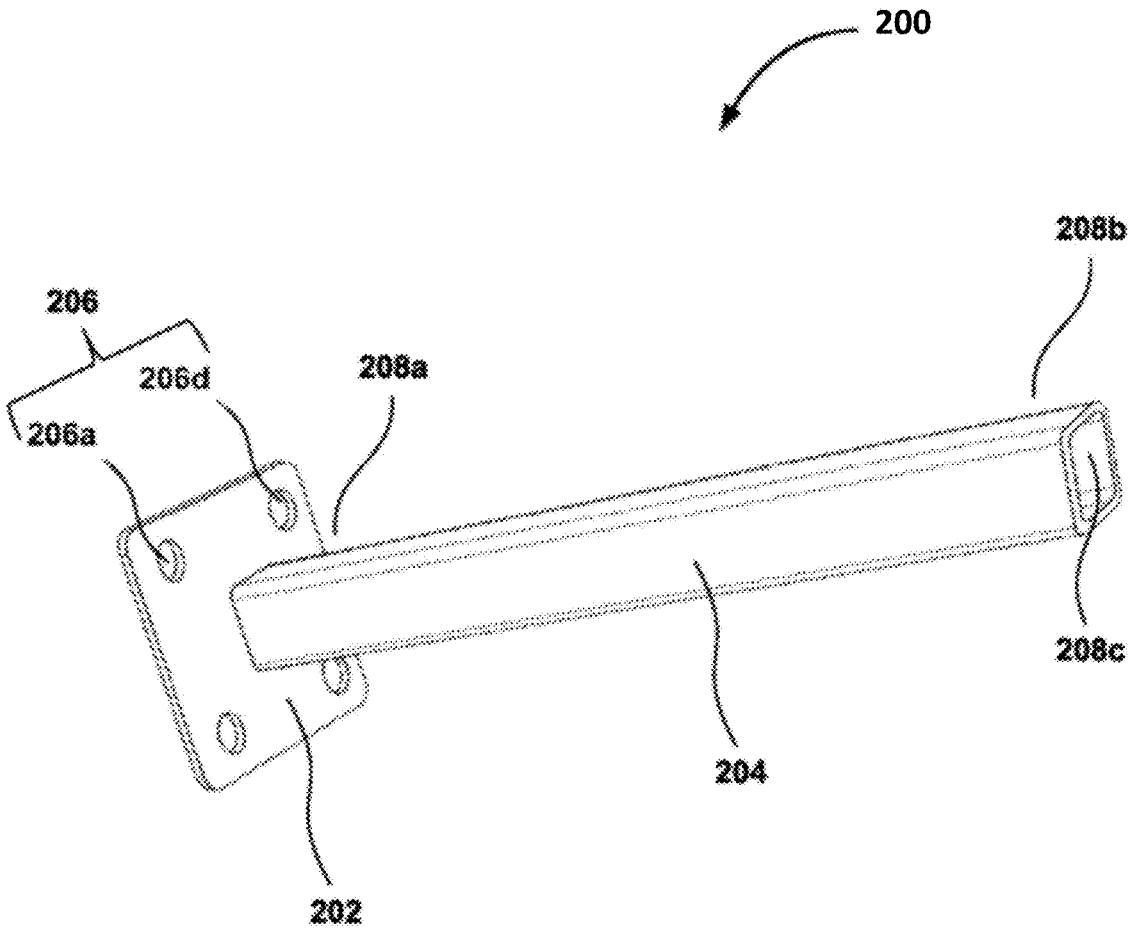
Figure 3:
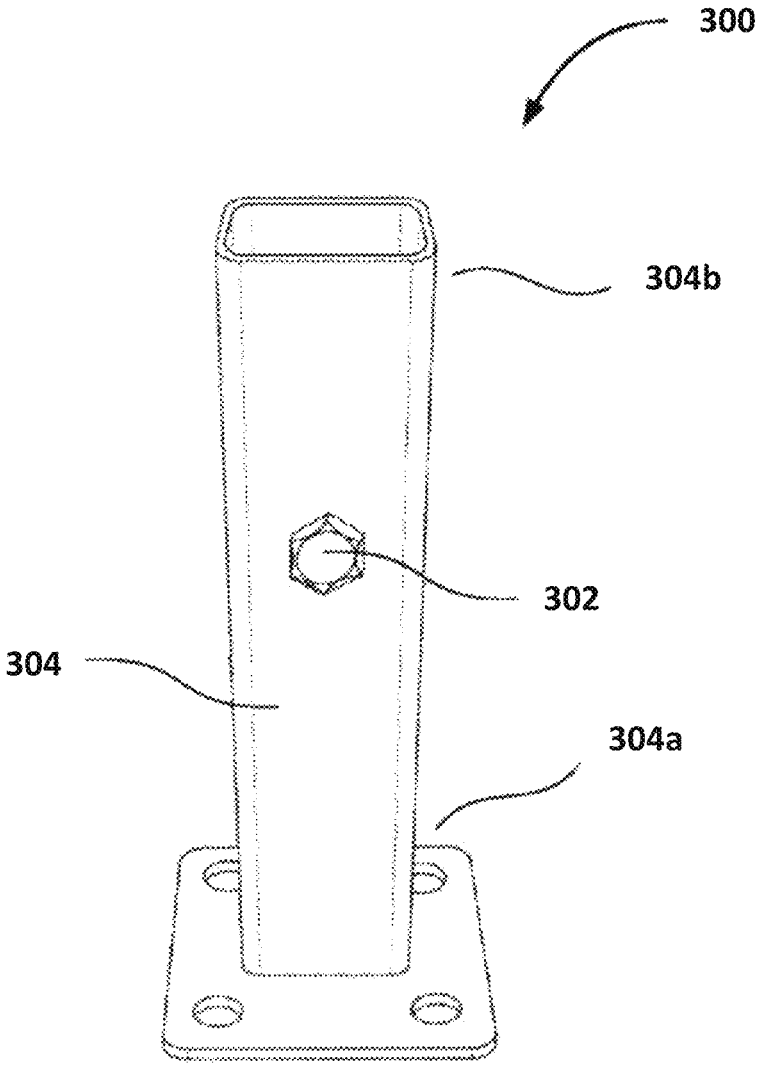
Figure 4:
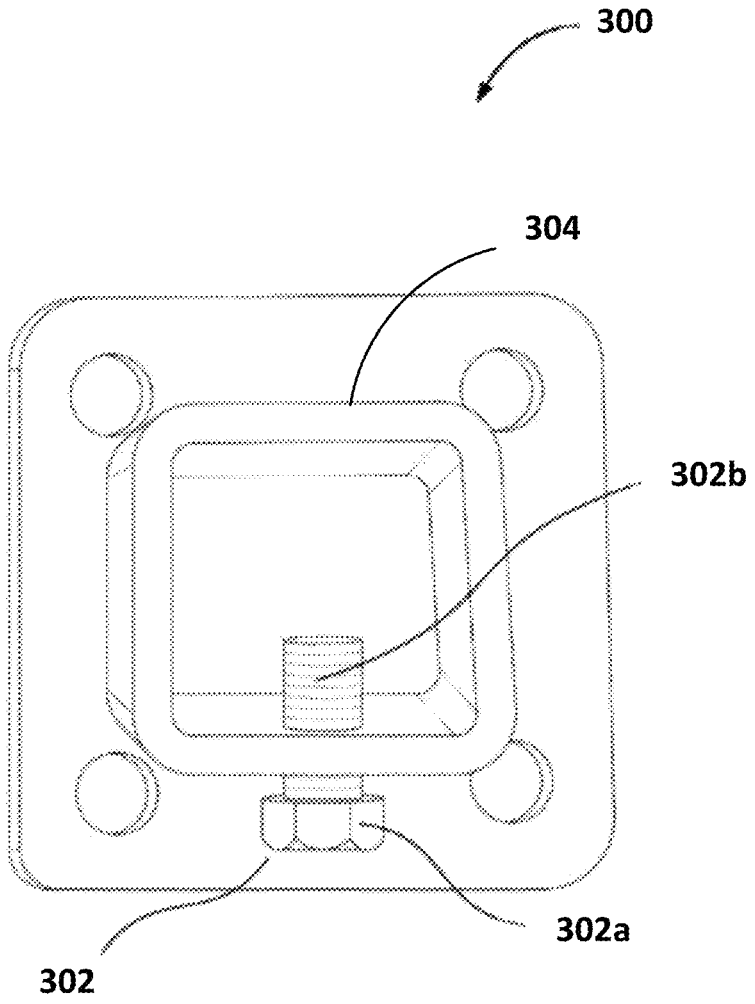
Figure 5:
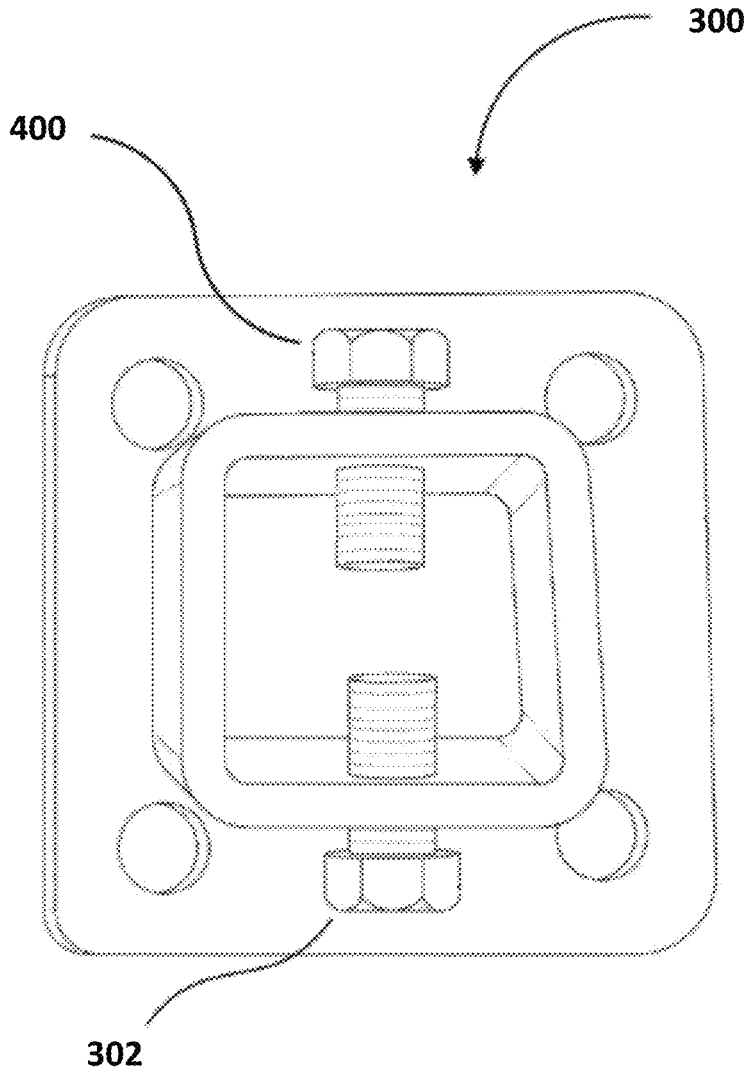
Figure 6:
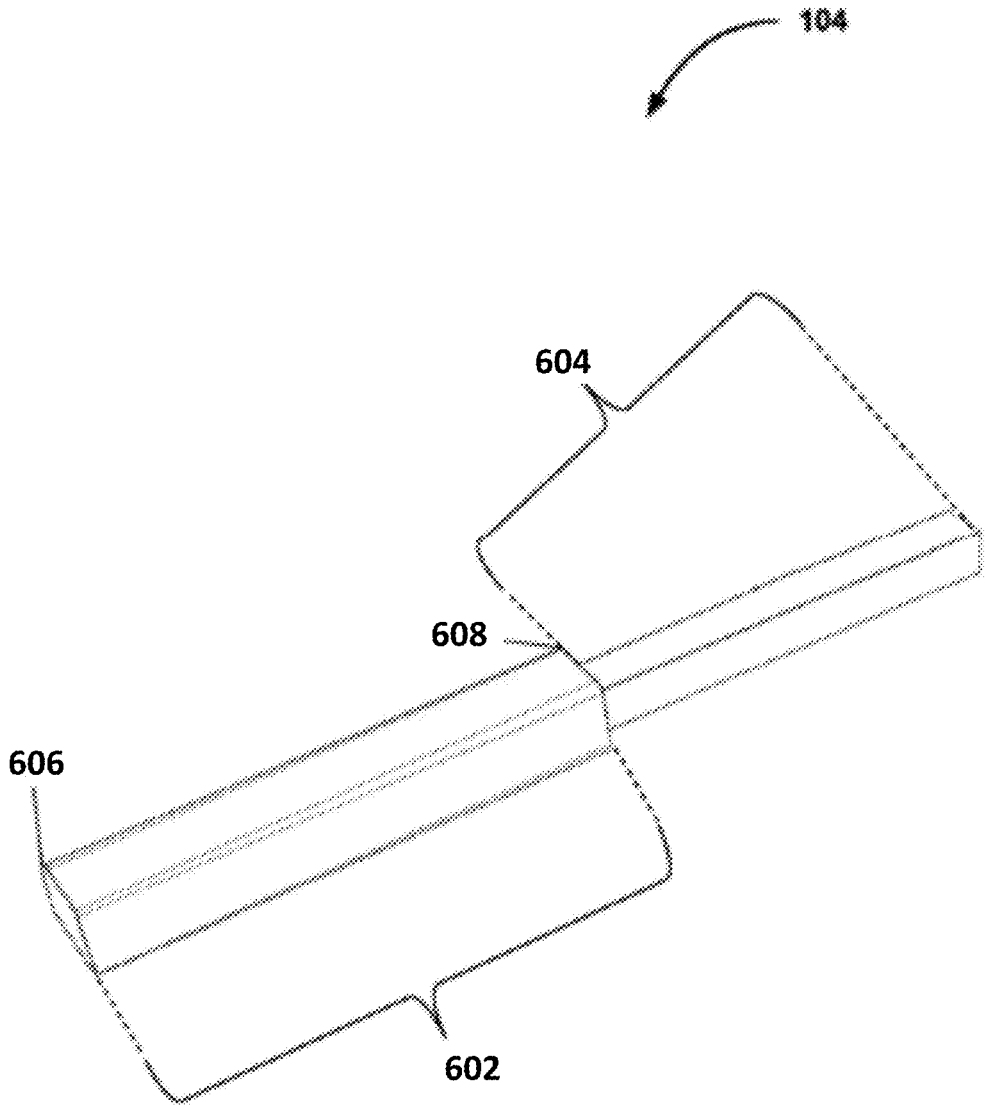
Figure 7:
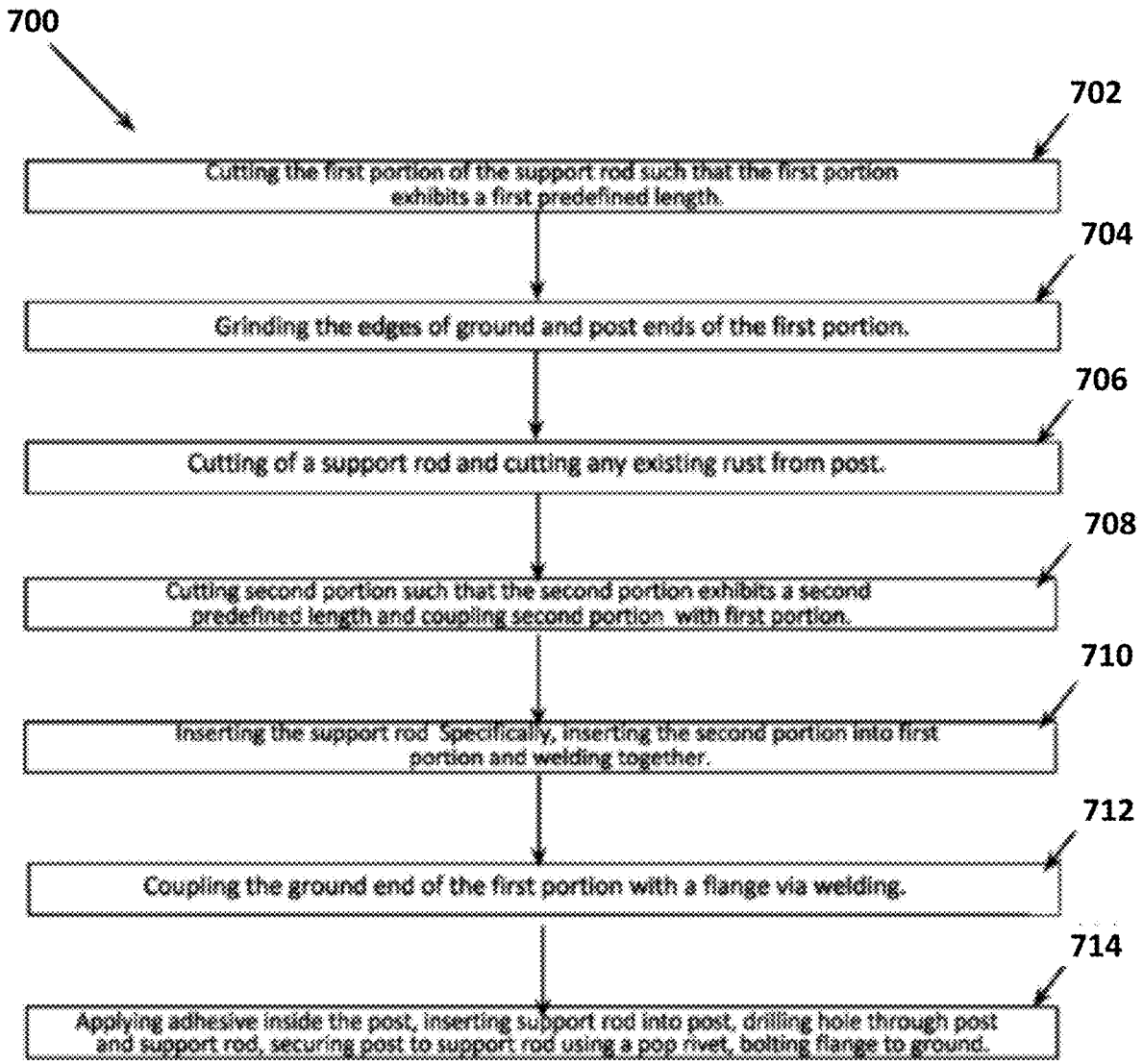
Figure 8:
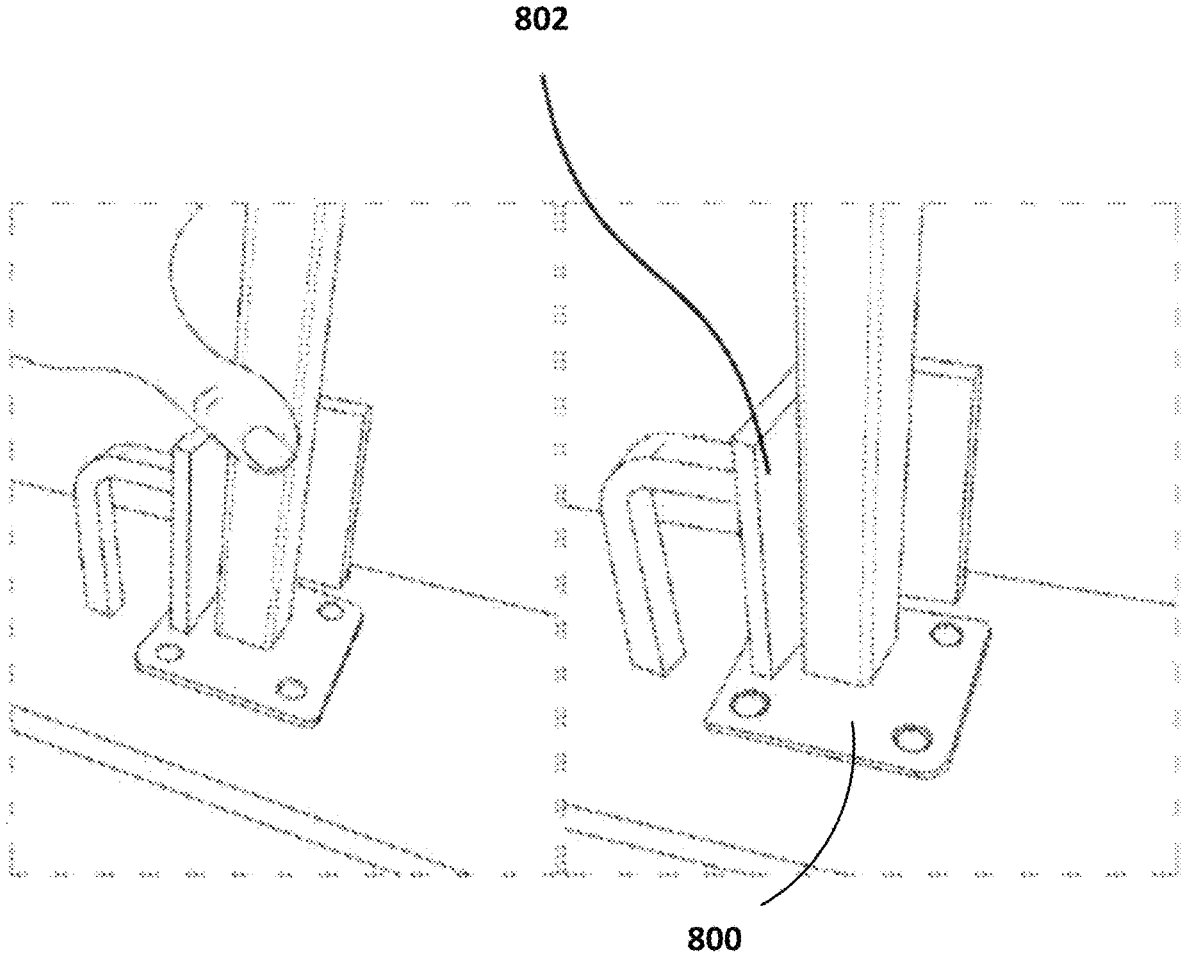
Figure 9:
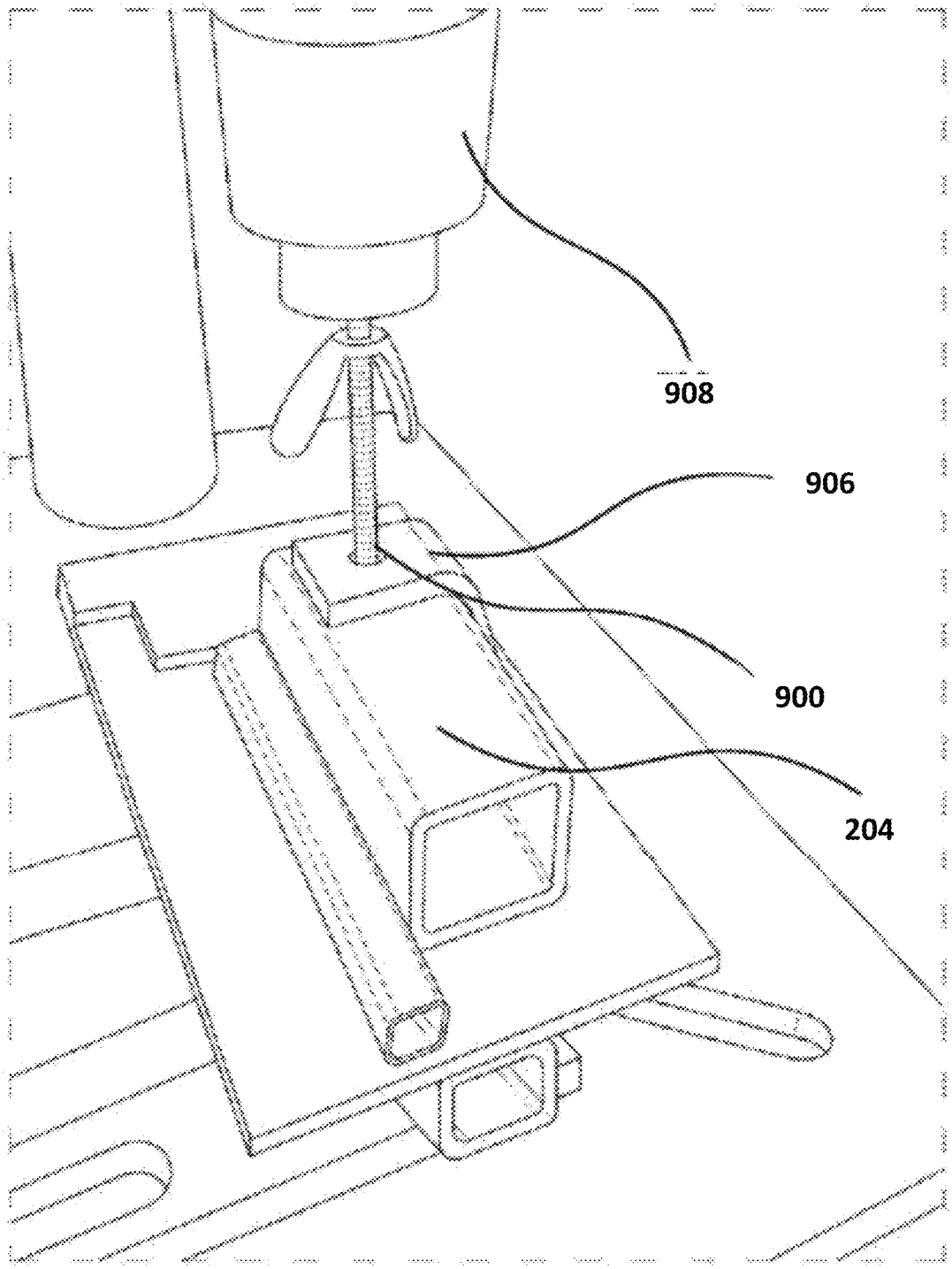
Figure 10:
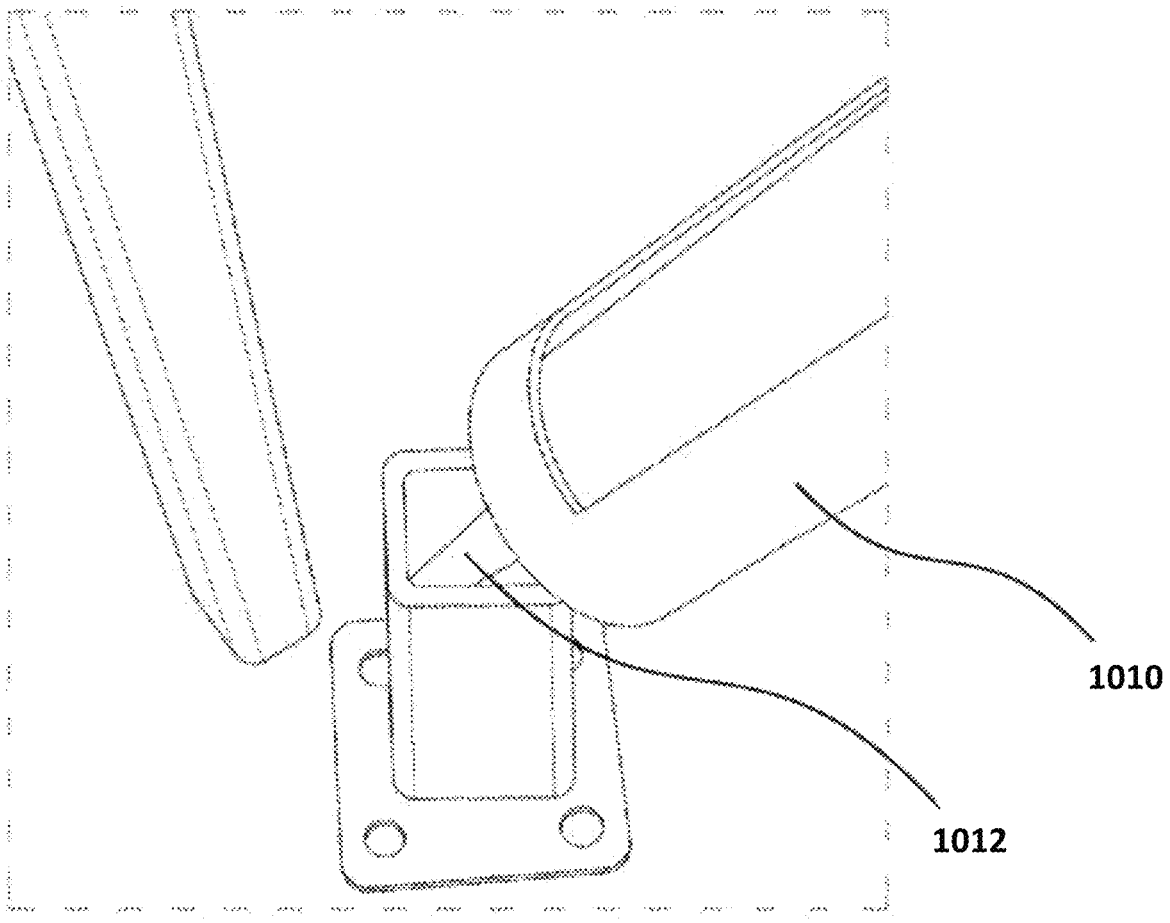
Figure 11:
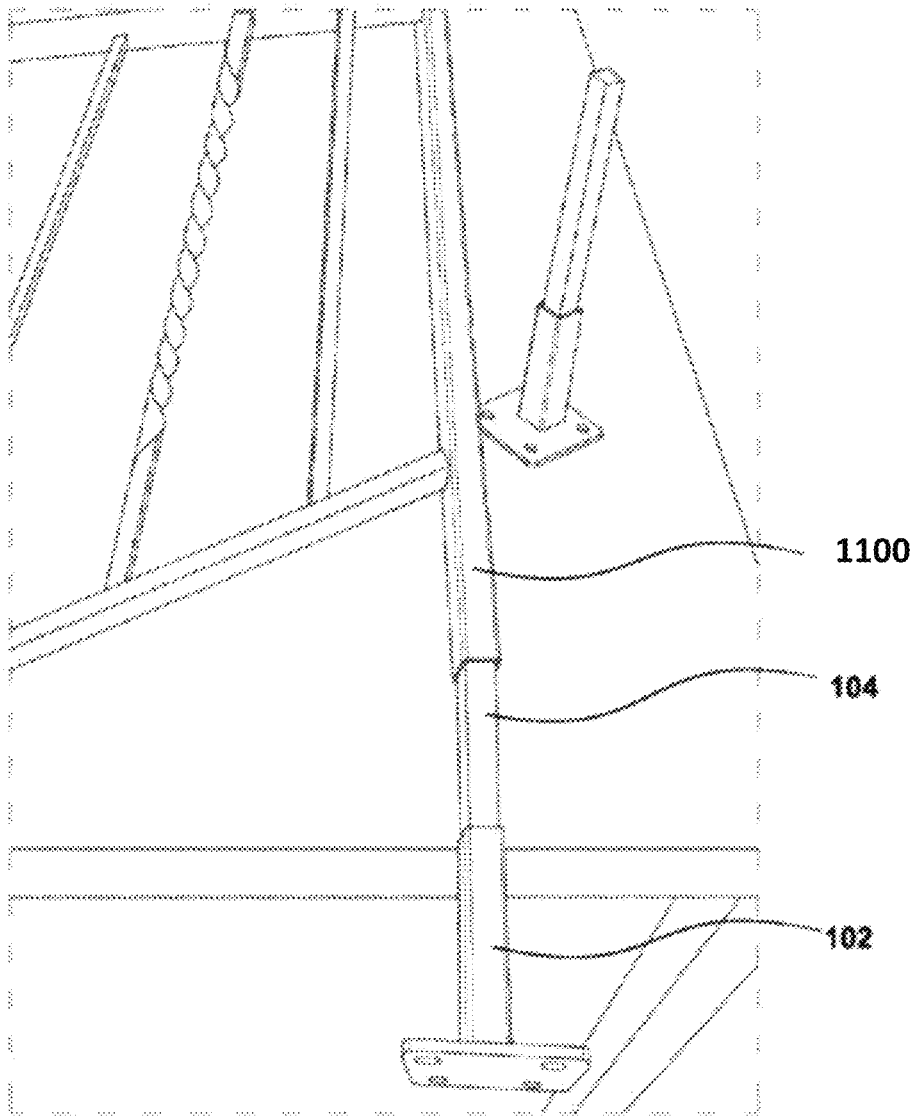
Figure 12:
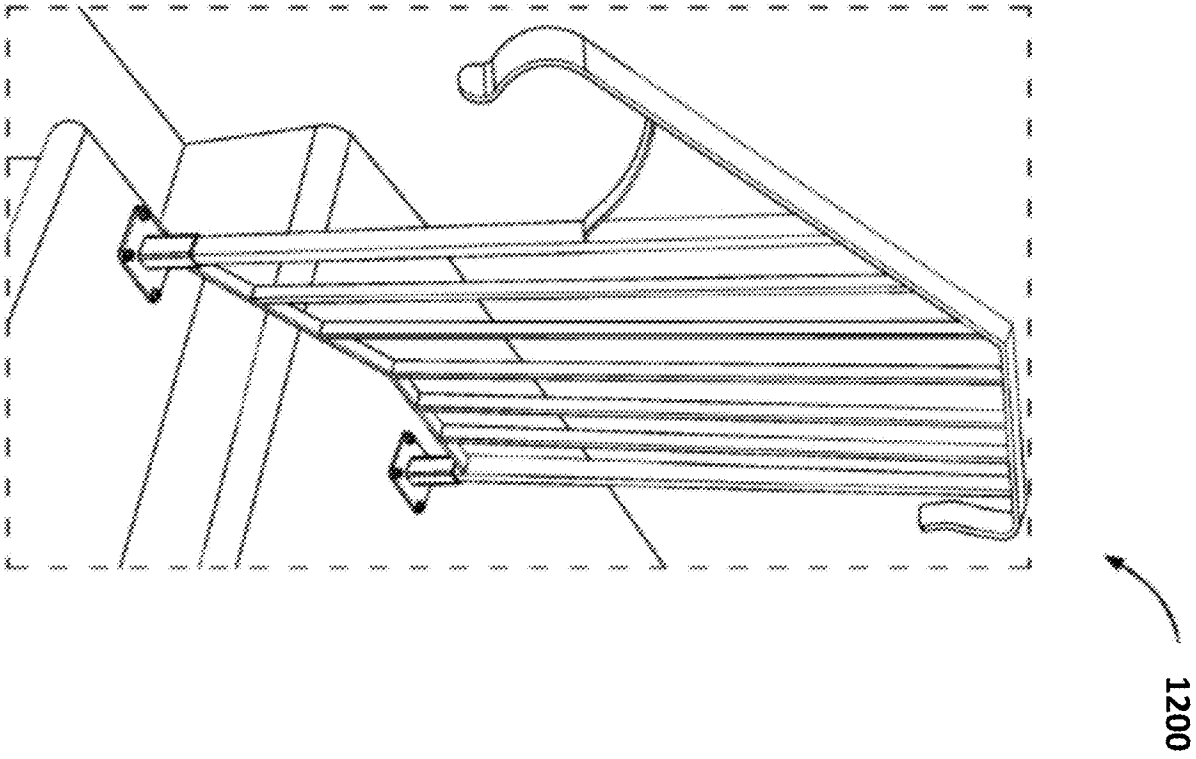
Figure 13:
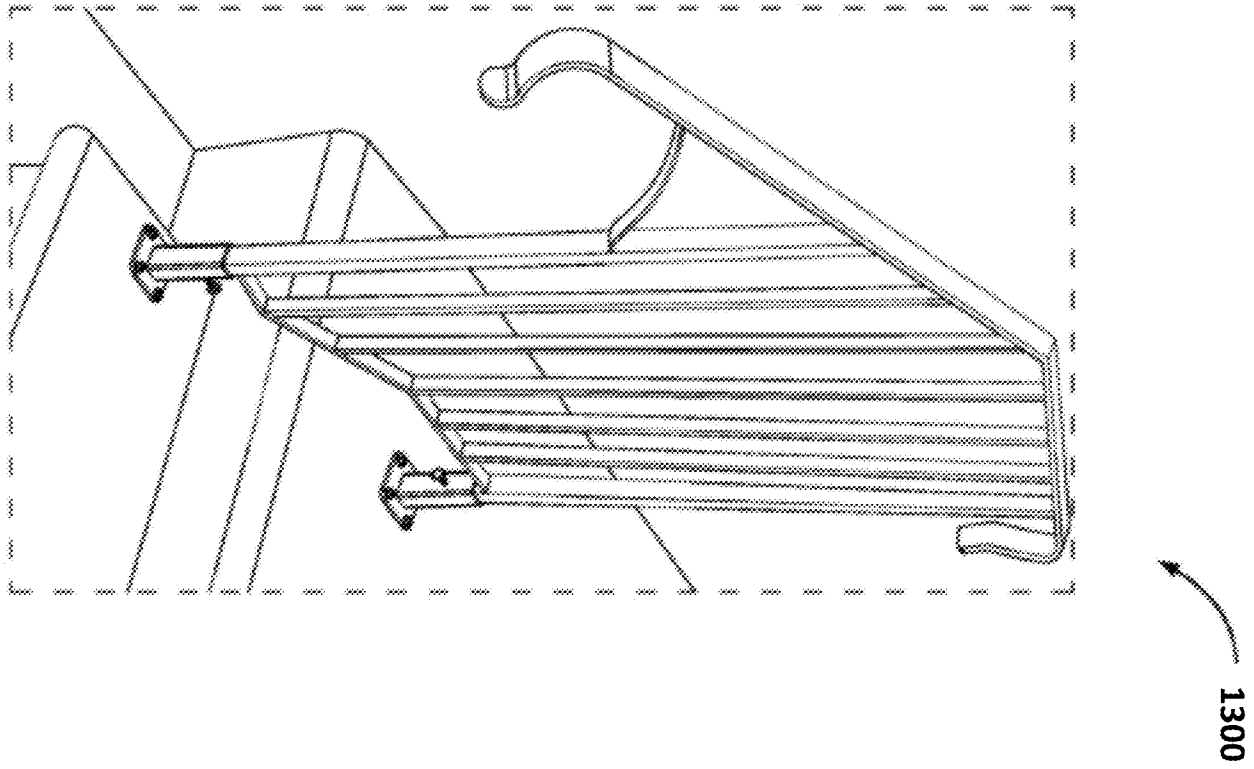

Having thus described the disclosure in general terms, reference will now be made to the accompanying figures, wherein:

FIG. 1 illustrates a perspective view of a support structure, in accordance with an embodiment of the present disclosure;

FIG. 2 illustrates a perspective view of a support structure, in accordance with an embodiment of the present disclosure;

FIG. 3 illustrates a front view of a support structure, in accordance with an embodiment of the present disclosure;

FIG. 4 illustrates a top view of the support frame of the FIG. 3, in accordance with an embodiment of the present disclosure;

FIG. 5 illustrates a top view of the support frame of the FIG. 3, in accordance with an embodiment of the present disclosure FIG. 6 illustrates a perspective view of a support rod of the support structure of FIG. 1, in accordance with an embodiment of the present disclosure;

FIG. 7 illustrates a flowchart depicting a method for assembling a support structure, in accordance with an embodiment of the present disclosure; and FIG. 8 illustrates a schematic view that shows alignment of a tube on a flange, in accordance with an embodiment of the present disclosure;

FIG. 9 illustrates a schematic view that shows a step of forming a hole on a tube of a support structure, in accordance with an embodiment of the present disclosure;

FIG. 10 illustrates a schematic view that shows a step of applying adhesive inside a tube of a support structure, in accordance with an embodiment of the present disclosure;

FIG. 11 illustrates a schematic view that shows a step of inserting the support rod of inside a post, in accordance with an embodiment of the present disclosure;

FIG. 12 illustrates a perspective view of a handrail that employs a support structure, in accordance with an embodiment of the present disclosure; and FIG. 13 illustrates a perspective view of a handrail that employs a support structure, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Before describing the present invention in detail, it should be observed that the present invention utilizes a combination of components or processes, which constitutes a support structure and a method for assembling the support structure. Accordingly, the components or processes have been represented, showing only specific details that are pertinent for an understanding of the present disclosure so as not to obscure the disclosure with details that will be readily apparent to those with ordinary skill in the art having the benefit of the description herein. As required, detailed embodiments of the present disclosure are disclosed herein; however, it is to be understood that the disclosed embodiments are merely exemplary of the invention, which can be embodied in various forms. Therefore, specific component level details and functional details disclosed herein are not to be interpreted as limiting, but merely as a basis for the claims and as a representative basis for teaching one skilled in the art to variously employ the present disclosure in virtually any appropriately detailed structure. Further, the terms and phrases used herein are not intended to be limiting but rather to provide an understandable description of the disclosure.

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods and systems similar or equivalent to those described herein can be used in the practice or testing of embodiments, the preferred methods, and systems are now described. The disclosed embodiments are merely exemplary.

References to "one embodiment", "an embodiment", "another embodiment", "one example", "an example", "another example" and so on, indicate that the embodiment(s) or example(s) so described may include a particular feature, structure, characteristic, property, element, or limitation, but that not every embodiment or example necessarily includes that particular feature, structure, characteristic, property, element or limitation.

As mentioned there remains a need for an efficient technique of repairing handrail posts. Accordingly, the present disclosure provides the support structure that solves the aforementioned problems of conventional handrails and associated components and repairing methods thereof. The support structure of the present disclosure, made from heavy-walled A36 steel tubing and solid square bar, offer a simple, economical solution to restore safety and functionality to loose, rusted, or broken handrail posts. The support structure of the present disclosure is designed to fit various shapes and sizes, they eliminate the need for complete rail replacement by preventing further rot and providing a durable, secure repair without the complexity of welding. This innovative approach addresses the overlooked handrail repair market, offering a practical and accessible solution for homeowners, contractor, and commercial handrails. This disclosed invention aims to eliminate a handrail post from any further contact with cement, therefore preserving the lifespan of the handrail posts.

The present disclosure pertains to or relates to a method of preventing rotting of metal posts that may be disposed below the ground or imbedded in cement. The support structure of the present disclosure may facilitate easy repairing of the metal posts by virtue of an existing leg. These repair feet slide inside a hollow handrail post or may slide over a handrail post acting as a casing/new base for metal posts to anchor on top of the cement. The support structure of the present disclosure may therefore eliminate concrete damage.

FIG. 1 illustrates a perspective view of a support structure 100, in accordance with an embodiment of the present disclosure. The support structure includes a support frame 106 and a support rod 104. The support rod 104 is inserted into a cavity 106 of the support structure

100. The support rod 104 is sized such that the support rod 104 is slightly smaller than the cavity 106 to allow for welded material to be inserted into the area between the support frame and the support rod 104 in the cavity 106.

The support structure 100 may be adapted to support a handrail. Specifically, the support structure 100 may be coupled to a ground and may support the handrail. The support structure 100 may be easily replaceable and repairable in the events of corrosion of the support structure 100. The support structure 100 may therefore save a lot of time and labor in repairing and replacing in the events of corrosion. The support structure 100 may facilitate easy repair for the handrail.

The support structure 100 may be provided with square or round metal tube or solid. In some embodiments of the present disclosure, the support structure 100 may have a piece of solid square bar or tube support rod 104 that may be inserted into the center and welded in place from the bottom of the support frame 106 and then welded to flange 102. In some embodiments of the present disclosure, the support structure 100 may be adapted to rest as such in an upright position. These support structures facilitate easy repair of the handrail for many homeowners, residential and commercial properties that may have loose broken or rotted out handrail posts. These support structures are not limited to just existing handrail posts. They can be used for a new installation of a new handrail as well.

The support structure 100 may therefore be a strong, secure, and an economical way to repair the handrail without incurring the expensive cost of having to replace the whole handrail itself. This advantageously improves functionality and safety for prolonged duration of time. Specifically, the support structure 100 may easily address the recurring issue of concrete causing metal handrail posts to rot out over time that are core drilled into cement and then anchored and held in place with cement. While the handrail itself often remains structurally sound, the rotting of the posts renders the handrail unsafe and unusable. The repair feet mitigate this problem by preventing concrete from eroding the metal posts, which typically become brittle and break away from their core-drilled positions 4" in the concrete. Featuring unique designs, these feet can be used on both existing and new rail installations without the need for welding. Crucially, they prevent handrail posts from needing to be set into concrete, thus eliminating future erosion. The repair process involves removing existing rust, adding adhesive inside hollow handrail posts, sliding the square bar extension into existing handrail post then securing through the post with a pop rivet attaching to the square bar inside the existing post and bolting down the base plate. Additionally flange 102 serves as a cosmetic cover for the existing hole in the cement.

In some embodiments of the present disclosure, dimensions of the hole of the support frame 106 may correspond to dimensions of the cross-section of the support rod 104 such that the support rod 104 is inserted into the support frame 106. Embodiments of the present disclosure are intended to include and/or otherwise cover any value for the dimensions of the hole of the support frame 106 and the dimensions of the cross-section of the support rod 104, without deviating from the scope of the present disclosure.

In some embodiments of the present disclosure, shape of the hole of the support frame 106 may be same to as of shape of the cross-section of the support rod 104 such that the support rod 104 is inserted into the support frame 106.

FIG. 2 depicts another embodiment of a repair device 200. The repair device 200 includes a flange 202 and a tube 204 with the flange including a plurality of holes 206. In one embodiment, flange 202 includes 4 holes 206*a*, 206*b* 206*c* and 206*d* each positioned near one of the corners of the flange. Flange 202 may be coupled to the tube 204 by way of a welding technique. Embodiments of the present disclosure are intended to include and/or otherwise cover any type of technique that may facilitate to couple the flange 202 to the tube 204, without deviating from the scope of the present disclosure.

In some embodiments of the present disclosure, the flange 202 may have a dimension that may be 3×3×⅛". In a preferred embodiment of the present disclosure, the holes each have a ⅜" diameter. Holes 206 may be secured to the concrete using a plurality of fastening means. Embodiments of the present disclosure are intended to include and/or otherwise cover any dimensional value for the flange 202, without deviating from the scope of the present disclosure. The tub 204 may be any length but preferably 3¾", 4", 6", 7", 8", 10" or 12". Embodiments of the present disclosure are intended to include and/or otherwise cover any dimensional value for the tube, without deviating from the scope of the present disclosure In some embodiments of the present disclosure, the flange 202 may have a shape that may be a rectangle, a square, a circle, a triangle, a rhombus, and the like. Embodiments of the present disclosure are intended to include and/or otherwise cover any type of known and later developed shape for the flange 202 that may provide adequate stability to the support structure 200, without deviating from the scope of the present disclosure.

The holes 206 may be disposed at corners of the flange 202. The holes 206 may facilitate to couple the support frame 200 with the ground. To couple the support frame 200 to the ground, a fastener (not shown) may be inserted in a corresponding hole 206. In other words, the support frame 200 may be coupled to the ground upon insertion of the fastener in the corresponding hole 206. For example, to couple the support frame 200 to the ground, the first fastener may be inserted in the first hole 206*a*, the second fastener may be inserted in the second hole 206*b*, the third fastener may be inserted in the third hole 206*c*, and the fourth fastener may be inserted in the fourth hole 206*d*.

In some embodiments of the present disclosure, the fastener may have a dimension of one of, ¼", 5⁄16' and ⅜". Embodiments of the present disclosure are intended to include and/or otherwise cover any dimension for the fastener depending on the dimensions of the flange 202, without deviating from the scope of the present disclosure.

In some embodiments of the present disclosure, the fastener may be one of, a concrete fastener, an anchor, a sleeve, a wedge bolt, and tap con. Embodiments of the present disclosure are intended to include and/or otherwise cover any type of known and later developed fastener, without deviating from the scope of the present disclosure.

The tube 204 may include a first end 208*a* and a second end 208*b*. The first end 208*a* and the second end 208*b* may be disposed opposite to each other. In other words, the tube 204 may have a length that may span between the first end 208*a* and the second end 208*b*. The flange 202 may be coupled to the first end 208*a*.

In some embodiments of the present disclosure, the tube 204 may have a cross-sectional shape of a square, a rectangle, and a circle. Accordingly, the shape of the hole 208*c* may be one of, the square, the rectangle, and the circle. Preferably, the tube 204 may have the cross-sectional shape of the square. Accordingly, the preferred shape of the hole 208*c* may be the square. Embodiments of the present disclosure are intended to include and/or otherwise cover any shape for the cross-section of the tube 204, without deviating from the scope of the present disclosure.

In some embodiments of the present disclosure, the support frame 204 may be coupled to a flange 202 by way of a welding technique. Embodiments of the present disclosure are intended to include and/or otherwise cover any type of technique that may facilitate to couple tube 204 to the ground end of the tube 208*a* to a flange 202, without deviating from the scope of the present disclosure.

In some embodiments of the present disclosure, the support frame 200 may have a length that may be one of, 12 inches, 10 inches, 8 inches, 7 inches, 6 inches, 4 inches, and 3.75 inches. Embodiments of the present disclosure are intended to include any dimensional value for the length of the support frame 200, without deviating from the scope of the present disclosure. The flange 202 may have any number of apertures that may be structurally, dimensionally, and configurationally same or substantially similar to at least one aperture of the first through fourth apertures 206*a*-206*d*, without deviating from the scope of the present disclosure.

FIG. 3 illustrates a front view of a support frame 300. The support frame 300 includes a lock element 302. The lock element 302 may be coupled to the tube 304 by drilling or tapping a hole that is threaded to allow a screw to engage the hole. The lock element 302 may be disposed between the first end 304*a* and the second end 304*b* of the tube 304. Preferably, the lock element 302 may be disposed near to the second end 304*b*. The lock element 302 may exhibit a locked position and an unlocked position. The lock element 302 may be moved or displaced that may facilitate the lock element 302 to exhibit the locked position and the unlocked position. In some examples of the present disclosure, the lock element 302 is screwed into the opening such that the front of the lock element 302 engages a post placed into tube 304.

The lock element 302 may pass through a wall or a side of the tube 304. In other words, the lock element 302 may be partially inserted through the wall or the side of the tube 304. The lock element 302 may engage with a post once adhesive is added into it. The lock element 302 when removed from the wall or the side of the tube 304, may disengage the post inside it. The lock element 302, in the locked position, may engage with the post such that the lock element 302 blocks or restrict sliding motion of the post within the tube 304. The lock element 302, upon restricting the sliding motion of the post to exhibit a stable position i.e., the at least one height from the range of heights.

The lock element 302 may be adapted to facilitate adjustment of the at least one height from the range of heights of the post within the tube 304. Specifically, the lock element 302, in the unlocked position, may facilitate adjustment of the at least one height of the post within the tube 304. The lock element 302, in the unlocked position, may disengage from the post such that the lock element 302 permits or allows the sliding of post within the tube 304.

In some embodiments of the present disclosure, the lock element 302 may be a bolt, nut, a rivet, and the like. Embodiments of the present disclosure are intended to include and/or otherwise cover any type of mechanical fastener that may be the lock element 302, without deviating from the scope of the present disclosure.

FIG. 4 illustrates a top view of the support frame 300 in accordance with an embodiment of the present disclosure. The lock element 302 may include a head portion 302*a* and tail portion 302*b*. The head portion 302*a* may remain outside the wall or the side of the tube 304. The tail portion 302*b* may be inserted inside the wall or the side of the tube 304 to set at least one height of the post within the tube 304.

FIG. 5 illustrates a top view of the support frame 300, in accordance with an embodiment of the present disclosure. The lock element 302 is positioned on one side of the tube 304 with an separate lock element 400 positioned on a side of the tube 304 opposite the lock element 302. In some embodiment, one side of the tube 304 include 2 locking elements. Both lock elements 302 and 400 are adjusted to secure the post in the cavity at a predetermined height.

In some embodiments of the present disclosure, the lock elements 302 and 400 may be rotated to facilitate insertion and ejection from the wall or the side of the tube 304. In one example of the present disclosure, the lock elements 302 and 400 may be rotated in a clockwise direction that may facilitate insertion of the lock elements 302 and 400 in the side or the wall of the tube 304. In some other examples of the present disclosure, the lock elements 302 and 400 may be rotated in a counterclockwise direction that may facilitate ejection of the lock elements 302 and 400 from the side or the wall of the tube 304. In some embodiments of the present disclosure, the lock elements 302 and 400 may include threaded region that may be disposed or formed at the tail portion 302*b*. The threaded region may facilitate rotation of the lock elements 302 and 400 in one of, the clockwise direction and in the counterclockwise direction. Embodiments of the present disclosure are intended to include and/or otherwise cover any direction i.e., the clockwise direction and the counterclockwise direction for rotating the lock elements 302 and 400 that may either facilitate (i) insertion of the lock elements 302 and 400 in the wall or the side of the tube 304 or (ii) the ejection of the lock elements 302 and 400 from the wall or the side of the tube 304, without deviating from the scope of the present disclosure.

FIG. 6 illustrates a perspective view of the support rod 104 of the support structure 100, in accordance with an embodiment of the present disclosure. The support rod 104 may include a first portion 602 and a second portion 604. The first portion 602 may be disposed adjacent to the second portion 604. The first portion 602 may extend along a first length of the support rod 104. In a preferred embodiment, the length of support rod 104 is at least 5 inches past first portion 602. The support rod 104 may be inserted inside first portion 602 and welded together. Specifically, the first portion 602 may be coupled with a flange on the same end where the first portion 602 was welded with support rod 104. The dimensions of the first portion 602 may be machined to correspond to the dimensions of the post.

In some embodiments of the present disclosure, the cross-sectional shape of the first portion 602 may be same to the cross-sectional shape of post. For example, the cross-sectional shape of the first portion 602 and post may be one of, a square, a rectangle, and a circle, without deviating from the scope of the present disclosure.

In some embodiments of the present disclosure, the cross-sectional shape of the first portion 602 may be different from the cross-sectional shape of the second portion 604. For example, the cross-sectional shape of the first portion 602 may be a square and the cross-sectional shape of the second portion 604 may be round.

In some embodiments of the present disclosure, the support rod 104 and the support structure 602 may have the length that may be in range of 3¾, 4, 6, 7, 8, 10, and 12." Preferably, the support rod 104 may have the length that may be 5" coming out of first portion 602. In some examples of the present disclosure, the first portion 602 may have the length of 4 inches and the second portion 604 may have a total length of 9" with the length of 5" coming out of first portion 602. Embodiments of the present disclosure are intended to include and/or otherwise cover any dimensional value for the length of the support rod 104 and support structure 602 without deviating from the scope of the present disclosure.

FIG. 7 illustrates a process 700 for assembling the support structure 100, in accordance with an embodiment of the present disclosure. At step 702, the assembling of the support structure 100 may require cutting the support rod 104. Specifically, cutting the first portion 602 such that the first portion 602 exhibits a first predefined length. At step 704, the assembling of the support structure 100 may require grinding edges. Specifically, grinding the edges of the ground end 606 and post end 608 of the first portion 602. At step 706, the assembling of the support structure 100 may require cutting of a support rod 604 and cutting any existing rust from post. At step 708, the assembling of the support structure 100 may require cutting of the second portion 604. Specifically, cutting the second portion 604 such that the second portion 604 exhibits a second predefined length and coupling second portion 604 with first portion 602.

At step 710, the assembling of the support structure 100 may require inserting the support rod 104. Specifically, inserting the second portion 604 into first portion 602 and welding together. At step 712, the assembling of the support structure 100 may require coupling the ground end 606 of the first portion 604 with a flange via welding. At step 714, the assembling of the support structure 100 may require applying adhesive inside the post and inserting support rod 104 into the post. A hole is then drilled through post into the inserted support rod 104 and secured using a pop rivet. A flange is then bolted into ground, securing support structure 100 to ground.

In some embodiments of the present disclosure, the post may be inserted directly into a support frame 300 without support rod 104 and a lock element 302 may exhibit the locked position such that the lock element 302 engages with a post. In some embodiments of the present disclosure, the lock element 302 may exhibit an unlocked position such that the lock element 302 disengages with the post.

FIG. 8 illustrates a schematic view that shows alignment of the support frame 200 on a flange 800, in accordance with an embodiment of the present disclosure. The support frame 200 may be supported by a bracket 802. The bracket 802 may be an upright member that facilitates to support the tube 204 along a portion of a vertical axis of the support frame 200. The bracket 802 may facilitate to hold the tube 204 in an upright straight position. Specifically, the bracket 802 may facilitate to hold the tube 204 that facilitates smooth and precise welding of the flange 800 with the tube 204.

FIG. 9 illustrates a schematic view that shows a step of forming a hole 900 on the tube 304, in accordance with an embodiment of the present disclosure. The tube 304 may be held in a set up 906 that facilitates to form the hole 900 on the tube 304. Specifically, the set up 906 may stably hold the tube 304 that facilitates a drilling apparatus 908 to form the hole 900 in the wall of the tube 304. In one embodiment, the tube 304 is a square tube having the dimensions of 3/16×1½". In another embodiment, the hole 900 is a 5/16" hole. In another embodiment, the hole 900 is threaded with a 5/16-18" tap. In one embodiment, a 3"×3"×3/16" flange is welded to the bottom of the tube 304.

FIG. 10 illustrates a schematic view that shows a step of applying adhesive inside the tube 304, in accordance with an embodiment of the present disclosure. The adhesive may be applied by an adhesive supplying member 1010. The adhesive supplying member 1010 may include a nozzle 1012. The nozzle 1012 may be inserted inside the tube 304 that may facilitate to efficiently apply the adhesive inside the tube 304 making it waterproof.

FIG. 11 illustrates a schematic view that shows a step of inserting the support rod 104 inside the post 1100, in accordance with an embodiment of the present disclosure. The support rod 104 may be inserted in the post 1100. The post 1100 may shroud or cover the support rod 104 to enable complete assembly of the support structure 100 and repairing the handrail.

FIG. 12 illustrates a perspective view of a hollow post handrail 1200 that employs the support structure 100, in accordance with an embodiment of the present disclosure. The hollow handrail post 1200 may be formed once the support structure 100 is completely assembled. The hollow handrail post 1200 may further facilitate the user to serve as a supporting means when the user walks or moves around the hollow handrail post 1200. The hollow handrail post 1200 may be robust by virtue of implementation of the support structure 100.

FIG. 13 illustrates a perspective view of a solid or hollow handrail post 1300 that employs the support structure 300, in accordance with an embodiment of the present disclosure. The solid or hollow handrail post 1300 may be formed once the support is completely assembled. The solid or hollow handrail post 700 may further facilitate the user to serve as a supporting means when the user walks or moves around the solid handrail post 700. The solid handrail post 700 may be robust by virtue of implementation of the support structure 300.

It should be understood according to the preceding description of the present invention that the same is susceptible to changes, modifications, and adaptations and that the said changes, modifications, and adaptations fall within the scope of the appended claims.

What I claim is:

1. A support structure for repairing a hollow handrail post, the support structure comprising:

a support frame having a flange base for stabilizing the support structure and a tube comprising a rail end and a ground end such that the tube is connected to the flange base at the ground end;

a solid support rod attached to and extending upwardly from the rail end of the tube, wherein the support rod extends into a hollow interior of the handrail post, such that a bottom of the handrail post rests on the rail end of the tube; and at least one locking element securing the support structure to the handrail post, wherein:

the handrail post is locked in position to the support structure by the at least one locking element, and the at least one locking element is a set screw or a pop rivet that is configured to adjustably set the height of the rail.

2. The support structure of claim 1, wherein the flange base further comprises a plurality of apertures to allow for insertion of a plurality of fasteners to secure the support frame to a surface.

3. The support structure of claim 2, wherein the plurality of fasteners are anchor bolts.

4. The support structure of claim 1, wherein the support rod protrudes a minimum of 5 inches.

5. The support structure as claimed in claim 1, wherein the tube has a length of 8 inches and the support rod has a length of 13 inches.

6. The support structure as claimed in claim 1, wherein the tube has a length of 6 inches and the support rod has a length of 11 inches.

7. The support structure as claimed in claim 1, wherein the tube has a length of 4 inches and the support rod has a length of 9 inches.

8. The support structure as claimed in claim 1, wherein the tube has a length of 3.75 inches and the support rod has a length of 8.75 inches.

9. The support structure of claim 1, wherein the support structure and the handrail post are formed of a metallic material.

10. A method for assembling a support structure for repairing a hollow handrail post, the method comprising:

cutting a tube having a first end and a second end such that the tube exhibits a first predefined length;

grinding edges of the first end and the second end of the tube;

coupling a flange base to the first end of the tube;

cutting a solid support rod such that the solid support rod has a second predefined length;

inserting the solid support rod within the tube such that the solid support rod extends upwardly from the second end of the tube;

welding together the solid support rod within the tube;

cutting rust off of the hollow handrail post;

applying adhesive inside the handrail post;

applying adhesive into the second end of the tube;

receiving the handrail post over the solid support rod such that a bottom of the handrail post rests on the second end of the tube;

drilling a hole through the existing handrail post and solid support rod;

securing, via at least one lock element, through the existing handrail post into the support rod;

setting the existing handrail post; and bolting the flange base to a surface, wherein the at least one lock element is a set screw or a pop rivet that is configured to adjustably set the height of the rail.

11. The method of claim 10, wherein the support structure and the handrail post are formed of a metallic material.

* * * * *